US007559750B2

(12) United States Patent
Jeong

(10) Patent No.: US 7,559,750 B2
(45) Date of Patent: Jul. 14, 2009

(54) OVERHEATING PROTECTION APPARATUS OF SCROLL COMPRESSOR

(75) Inventor: Chan-Hwa Jeong, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 317 days.

(21) Appl. No.: 11/013,396

(22) Filed: Dec. 17, 2004

(65) Prior Publication Data

US 2005/0135940 A1 Jun. 23, 2005

(30) Foreign Application Priority Data

Dec. 19, 2003 (KR) ..... 10-2003-0094023

(51) Int. Cl.
*F04B 49/00* (2006.01)

(52) U.S. Cl. ..... 417/292; 417/283; 417/310; 236/93 R

(58) Field of Classification Search ..... 417/32, 417/283, 284, 292, 310, 902, 304, 308; 236/93 R
See application file for complete search history.

(56) References Cited

U.S. PATENT DOCUMENTS 5,248,244 A * 9/1993 Ho et al. ..... 417/292
5,290,154 A * 3/1994 Kotlarek et al. ..... 417/292
5,385,453 A * 1/1995 Fogt et al. ..... 417/410.5
5,607,288 A * 3/1997 Wallis et al. ..... 417/310
5,707,210 A * 1/1998 Ramsey et al. ..... 417/32
5,967,409 A * 10/1999 Benedict ..... 236/92 R
6,095,765 A * 8/2000 Khalifa ..... 417/310
6,210,120 B1 * 4/2001 Hugenroth et al. ..... 417/32
6,341,945 B1 * 1/2002 Hugenroth et al. ..... 417/214
6,419,457 B1 * 7/2002 Seibel et al. ..... 417/213

(Continued)

FOREIGN PATENT DOCUMENTS

JP 07-189945 A 7/1995

(Continued)

OTHER PUBLICATIONS

"Distortion." The American Heritage® Dictionary of the English Language, Fourth Edition. Houghton Mifflin Company, 2004. Sep. 30, 2007. <Dictionary.com http://dictionary.reference.com/browse/distortion>.Free software! Get instant dictionary, thesaurus, and encyclopedia access from most Mac and Windows programs.*

*Primary Examiner*—Devon C Kramer
*Assistant Examiner*—Leonard J Weinstein
(74) *Attorney, Agent, or Firm*—Birch, Stewart, Kolasch & Birch, LLP

(57) ABSTRACT

Provided is an overheating protection apparatus of a scroll compressor which comprises: a bypass passage formed in a fixed scroll, for connecting a high pressure chamber to a low pressure chamber; a valve assembly installed on the bypass passage, for opening/closing the bypass passage; and a heat distortion member for bypassing gas of high temperature and high pressure inside the high pressure chamber to the low pressure chamber by driving the valve assembly toward a direction of opening/closing the bypass passage when a temperature inside the high pressure chamber rises more than an established value. According to this, when a discharged gas rises to an abnormal high temperature, gas inside the high pressure chamber is bypassed to the low pressure chamber, thereby protecting the compressor and also improving reliability thereof.

17 Claims, 4 Drawing Sheets

U.S. PATENT DOCUMENTS

| | | | | |
|---|---|---|---|---|
| 6,672,845 | B1 * | 1/2004 | Kim et al. | 417/310 |
| RE40,399 | E * | 6/2008 | Hugenroth et al. | 417/32 |
| 7,476,089 | B2 * | 1/2009 | Kim | 417/292 |
| 2003/0035736 | A1 * | 2/2003 | Nam | 417/292 |

FOREIGN PATENT DOCUMENTS

| | | | |
|---|---|---|---|
| JP | 07-301186 | A | 11/1995 |
| JP | 08-210278 | A | 8/1996 |
| JP | 3073018 | B2 | 6/2000 |
| JP | 2002-147873 | A | 5/2002 |
| KR | 10-0194078 | B1 | 6/1999 |
| KR | 10-0246707 | B1 | 4/2000 |
| WO | WO-93/19295 | | 9/1993 |

* cited by examiner

OVERHEATING PROTECTION APPARATUS OF SCROLL COMPRESSOR

BACKGROUND OF THE INVENTION

1. Field of the Invention

The present invention relates to an overheating protection apparatus of a scroll compressor, and particularly, to a scroll compressor having an overheating protection apparatus capable of improving reliability thereof and protecting it by bypassing discharged gas to a low pressure chamber if a temperature inside a compression chamber rises over an established temperature.

2. Description of the Background Art

In general, various types of compressor can be applied according to a compressing method, and a scroll compressor is usually used in an air conditioning system for which a miniature or a lightweight is required.

FIG. 1 is sectional view of a scroll compressor according to the conventional art.

The conventional scroll compressor is comprised of: a casing 106 respectively connected to a suction pipe 102 in which fluid is sucked and to a discharge pipe 104 through which a compressed fluid is discharged, and having a certain sealed space; a driving unit 108 set in a lower side of the casing 106, for generating a driving force; and a compressed unit 110 set in an upper side of the casing 106 and connected to the driving unit 108 and a rotating shaft 112, for compressing the fluid sucked in the suction pipe 102 by a rotation of the rotating shaft 112 to discharge it through the discharge pipe 104.

A main frame 114 is installed at the upper side of the casing 106 to rotatably support an upper side of the rotating shaft 112 and to support the compressed unit 110. A lower frame 116 is installed at the lower side of the casing 106 to rotatably support a lower side of the rotating shaft 112.

The driving unit 108 is comprised of a stator 122 fixed to the casing 106 in a circumferential direction and a rotor 124 set in an inner circumferential surface and fixed to the rotating shaft 112. If power is applied to the stator 122, the rotor 124 is rotated by an interaction between the stator 122 and the rotor 124 thereby to rotate the rotating shaft 112.

The compressed unit 110 is comprised of: a fixed scroll 128 having a fixed wrap of an involute shape therein and fixed to an upper side of the casing 106; and an orbiting scroll 132 having an orbiting wrap 130 of the involute shape therein, which corresponds to the fixed wrap 126, in order to have a certain compression chamber 118 between the fixed wrap 126 and the orbiting wrap 130 itself, supported at the main frame 114 to be orbited, and performing an orbiting movement during a rotation of the rotating shaft 112.

A discharging passage 136 is formed at the center of the fixed scroll 128 to discharge fluid compressed at the compression chamber 118 by an interaction between the fixed wrap 126 and the orbiting wrap 130. Further, a check valve 138 is installed at an upper side of the discharging passage 136 for preventing the discharged fluid from being flowed backward.

Moreover, a muffler 140 is mounted on an upper side of the fixed scroll 128 to reduce noise of gas discharged through the discharging passage 136, and an oldham ring 150 is installed between the orbiting scroll 132 and the main frame 114 for preventing the orbiting scroll 132 from being rotated.

Also, a temperature sensor (not shown) is installed to sense a temperature of the gas in the discharge pipe 104 discharging the compressed gas by being connected to a high pressure chamber 142 or inside the high pressure chamber 142, which is formed by the muffler 140 and into which the compressed gas is flowed. The temperature sensor cuts off power applied to the compressor if a temperature inside the high pressure chamber 142 rises more than an established value, and thereby the compressor can be protected.

As stated above, in the conventional scroll compressor, if power is applied to the stator 122, the rotor 124 is rotated by an interaction between the stator 122 and the rotor 124, and the rotating shaft 112 fixed to the rotor 124 is thus rotated in a forward direction. Thereby, the orbiting scroll 132 performs an orbiting movement by the rotation of the rotating shaft 112, so that the gas flowed in the compression chamber 118 by the interaction with the fixed scroll 128 is compressed to be flowed into the high pressure chamber 142 through the discharging passage 136. Thereafter, the gas flowed into the high pressure chamber 142 is discharged outside through the discharge pipe 104

At this time, the check valve 138 installed in the discharging passage 136 prevents the fluid discharged to a high pressure portion through the discharging passage 136 from being flowed backward to a low pressure portion.

However, as aforementioned, in the scroll compressor according to the conventional art, since a separate electric circuit (such as the temperature sensor to sense the temperature inside the high pressure chamber) should be constructed, manufacturing costs therefor can be increased. Furthermore, after the temperature inside the high pressure chamber is sensed by operating the temperature sensor, an operation of the compressor is stopped. As a result of this, an operation delay or an erroneous operation can be occurred, thereby damaging the compressor.

SUMMARY OF THE INVENTION

Therefore, an object of the present invention is to provide an overheating protection apparatus of a scroll compressor capable of protecting the compressor and of improving reliability thereof by bypassing gas inside a high pressure chamber to a low pressure chamber when discharged gas rises to an abnormal high temperature.

To achieve these and other advantages and in accordance with the purpose of the present invention, as embodied and broadly described herein, there is provided an overheating protection apparatus of a scroll compressor, comprising: a bypass passage formed in a fixed scroll, for connecting a high pressure chamber to a low pressure chamber; a valve assembly installed on the bypass passage, for opening/closing the bypass passage; and a heat distortion member for bypassing gas of high temperature and high pressure inside the high pressure chamber to the low pressure chamber by driving the valve assembly towards a direction of opening the bypass passage when a temperature of the high pressure chamber rises over an established value.

The valve assembly is comprised of: a valve housing formed in the fixed scroll and connected to the bypass passage; a valve body linear-movably set in the valve housing, for opening/closing the bypass passage; and a spring set in one side surface of the valve body, for providing an elastic force to the valve body.

The heat distortion member is installed in a mounting groove formed at an upper surface of the fixed scroll. The mounting groove is connected to a passage which is opened/closed by the heat distortion member. The passage is connected to the valve housing of the valve assembly.

A motor protection apparatus may be installed in the low pressure chamber of the casing to stop the operation of the compressor when the overheating protection apparatus is driven and thereby the gas of the high temperature and high pressure in the high pressure chamber is flowed into the low pressure chamber.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A preferred embodiment of an overheating protection apparatus of a scroll compressor in accordance with the present invention will be described with reference to the attached drawings, hereinafter.

There can be various embodiments for the overheating protection apparatus of the scroll compressor in accordance with the present invention. Hereinafter, an explanation of the most preferred embodiment therefor will be described.

Figure 1:
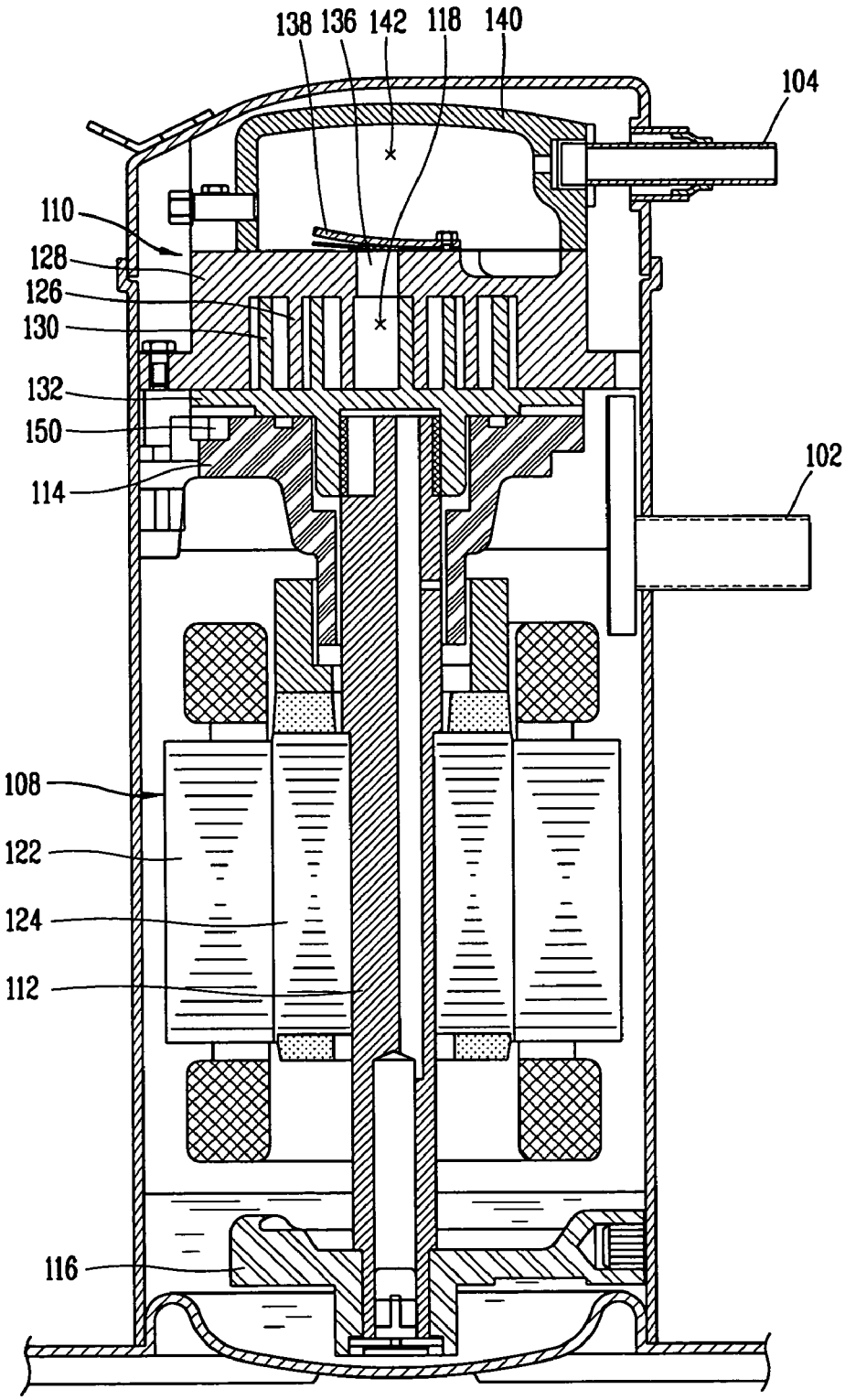
FIG. 1 CONVENTIONAL ART
FIG. 1 is a sectional view showing a scroll compressor according to the conventional art.
Figure 2:
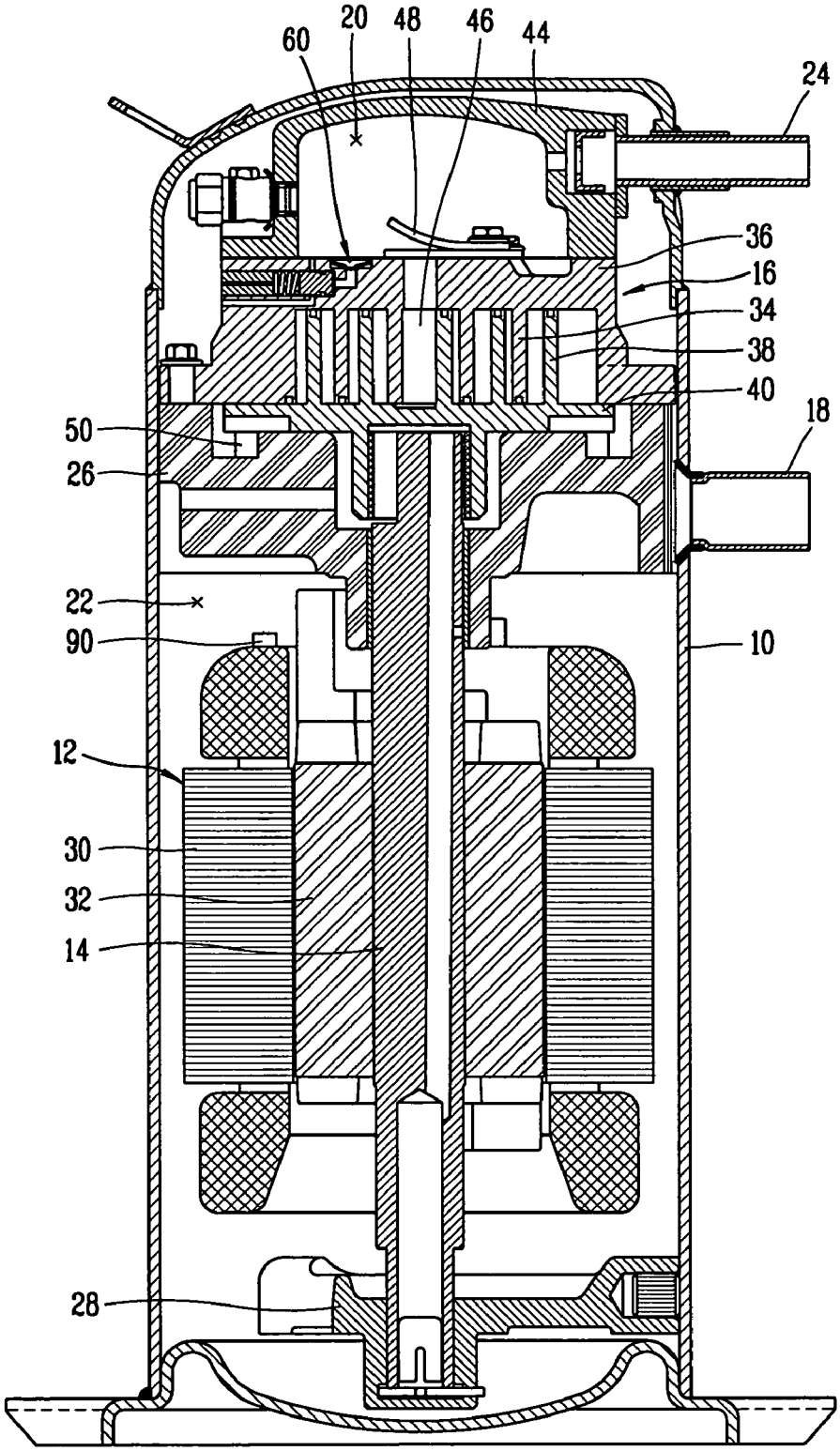
FIG. 2 is a sectional view showing a scroll compressor according to the present invention.

FIG. 2 is a sectional view of a scroll compressor in accordance with the present invention.

The scroll compressor according to the present invention is comprised of: a casing 10 having a certain sealed space; a driving motor 12 installed in the casing 10, for generating a driving force; a compressed unit 16 connected to the driving motor 12 and a rotating shaft 14, for compressing fluid and then discharging it outside when the driving motor 12 is driven; and an overheating protection apparatus 60 installed at one side of the compressed unit 16, for protecting the compressor by bypassing high temperature gas in a high pressure chamber 20 to a low pressure chamber 22 in the casing 10 when a temperature of the high pressure chamber 20 formed in the compressed unit 16 rises over an established value.

The casing 10 is respectively connected to a suction pipe 18 into which gas is sucked and to a discharge pipe 24 through which a compressed gas is discharged. The casing 10 has a main frame 26 therein for rotatably-supporting the rotating shaft 14 and also supporting the compressed unit 16, and a lower frame 28 therein for rotatably-supporting the lower end portion of the rotating shaft 14.

The driving motor 12 includes a stator 30 fixed to an inner circumferential surface of the casing 10, and a rotor 32 set in an inner circumferential surface of the stator 30 and fixed to the rotating shaft 14. When power is applied to the stator 30, the rotor is rotated by an interaction between the stator 30 and the rotor 32 thereby to rotate the rotating shaft 14.

At an upper end portion of the stator 30 is installed a motor protection apparatus 90 which is heated up by gas of high temperature and high pressure flowed in the low pressure chamber 22 from the high pressure chamber 20, depending on the operation of the overheating protection apparatus 60, thereby stopping the operation of the compressor.

That is, the motor protection apparatus 90 is heated up by the gas of the high temperature and the high pressure bypassed from the high pressure chamber 20 to the low pressure chamber 22 and thereby stops the operation of the compressor. As a result of this, the stator 30 of the driving motor 12 can be protected.

The compressed unit 16 is comprised of: a fixed scroll 36 having a fixed vane 34 of an involute shape therein, and fixed to an upper side of the casing 10; an orbiting scroll 40 having an orbiting vane 38 of the involute shape corresponding to the fixed vane 34 therein in order to have a compression chamber between the fixed vane 34 and the orbiting vane 38 itself, and performing an orbiting movement during a rotation of the rotating shaft 14 by being supported at the main frame 26 to be orbited; and a muffler 44 fixed to an upper surface of the fixed scroll 36, for forming the high pressure chamber 20 to which the fluid compressed at the compression chamber 42 is discharged and reducing noise generated from the discharged fluid.

A discharging hole 46 is formed in the center of the fixed scroll 36 to discharge the gas compressed by an interaction between the fixed vane 34 and the orbiting vane 38 to the high pressure chamber 20. A check valve 48 is installed at an upper side surface of the fixed scroll 36 to open/close the discharging hole 46, thereby protecting the fluid from being flowed backward.

Moreover, an oldham ring 50 is installed between the orbiting scroll 40 and the main frame 26 to prevent the orbiting scroll 40 from being rotated.

Figure 3:
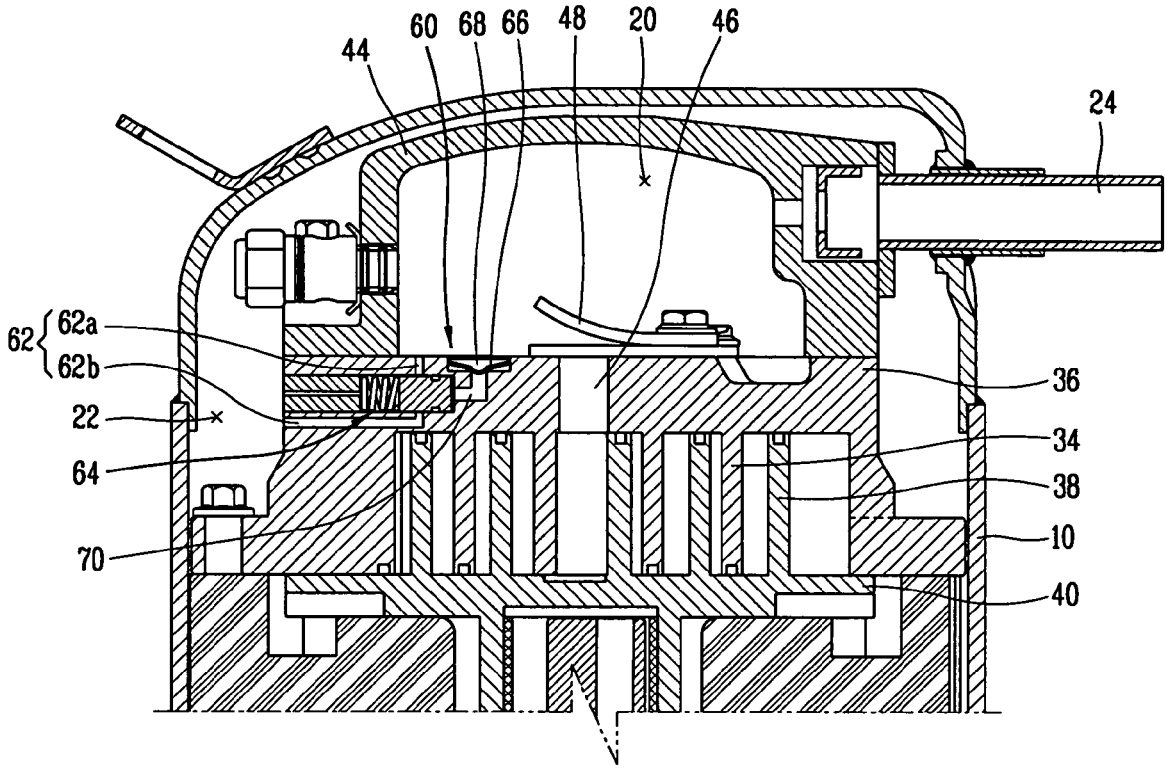
FIG. 3 is a sectional view showing a compressed unit of a scroll compressor according to the present invention.
Figure 4:
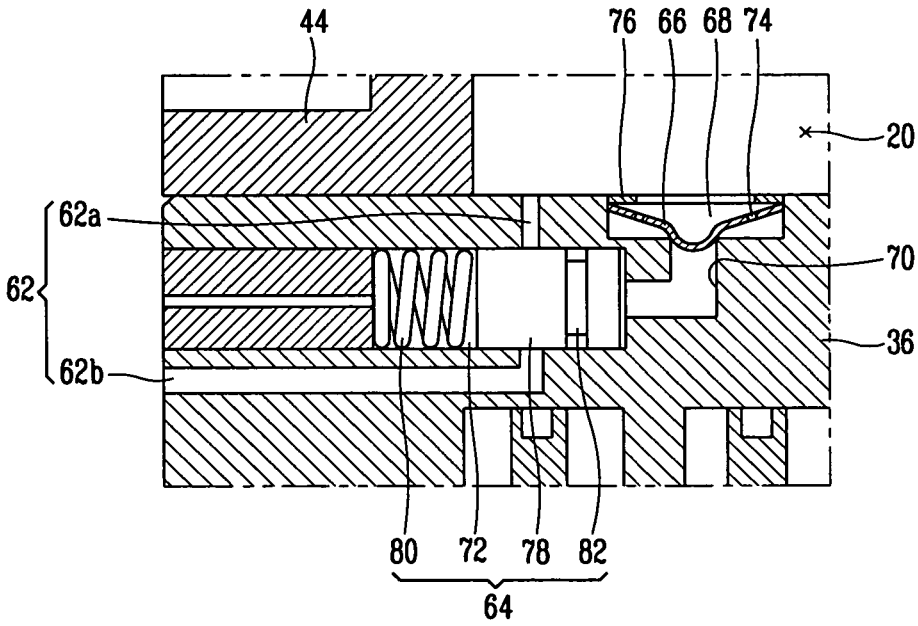
FIG. 4 is a sectional view showing an overheating protection apparatus of the scroll compressor in accordance with the present invention.

The overheating protection apparatus 60, as can be seen from FIGS. 3 and 4, is comprised of: a bypass passage 62 formed in the fixed scroll 36 including the high pressure chamber 20, for connecting the high pressure chamber 20 to the low pressure chamber 22; a valve assembly 64 installed on the bypass passage 62, for opening/closing the bypass passage 62; and a heat distortion member 66 for driving the valve assembly 64 when a temperature of the high pressure chamber 20 in the fixed scroll 36 rises more than an established value.

A mounting groove 68 to arrange the heat distortion member 66 is formed in an upper surface of the fixed scroll 36. A passage 70, which is extended from the mounting groove 68 thereby to be opened/closed by the heat distortion member 66, is formed. The passage 70 is formed to be connected to a valve housing 72 of the valve assembly 64.

The heat distortion member 66 is formed as a plate-like type made the center thereof concave to maintain a state that the passage is sealed, and a plurality of through holes 74 through which gas is passed are formed at a circumferential surface thereof. Furthermore, a separation preventing cover 76 is mounted on the mounting groove 68 to prevent the heat distortion member 66 from being separated.

This heat distortion member 66 is preferably formed as a bimetal-like type. Thereby, the heat distortion member 66 is spontaneously varied when heat over a certain value is supplied and thereby the concave portion thereof is convexly protruded to open the passage 70.

The valve assembly is comprised of: a valve housing 72 connected to the passage 70 and formed in the fixed scroll 36; a valve body 78 of a cylindrical shape linear-movably set in the valve housing 72, for opening/closing the bypass passage 62; and a spring 80 set in one side surface of the valve body 78, for providing an elastic force to the valve body 78.

Here, the bypass passage 62 includes: a first passage 62*a* connected between the high pressure chamber 20 and the valve housing 72, and a second passage 62*b* connected between the valve housing 72 and the low pressure chamber 22. The valve body 78 has a land portion 82 with a short diameter therein for connecting the first passage 62*a* and the second passage 62*b*.

An operation of the scroll compressor with the aforementioned construction according to the present invention will be described as follows.

Figure 5:
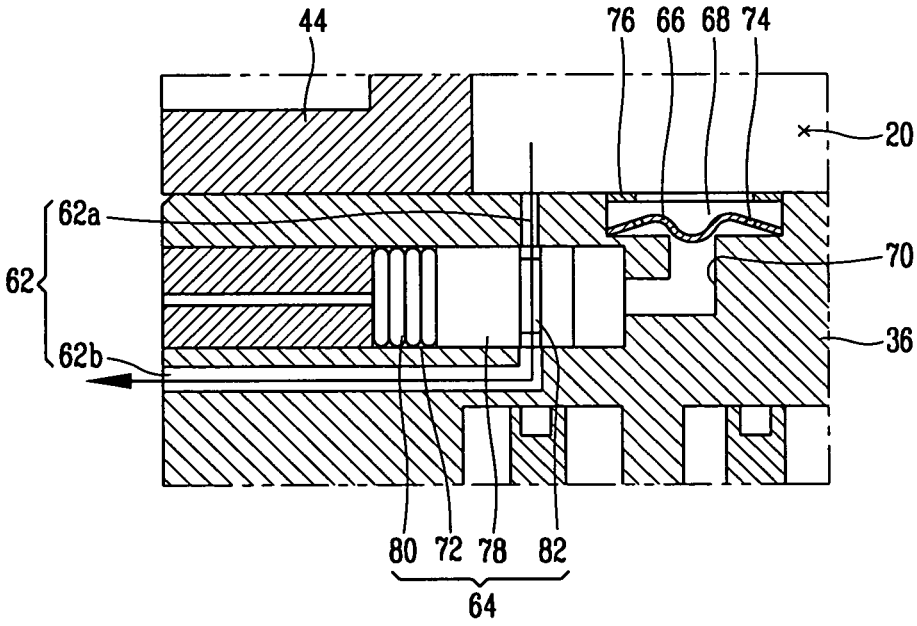
FIG. 5 is a state diagram showing an operation of the overheating protection apparatus of a scroll compressor in accordance with the present invention.

FIG. 5 is a state diagram showing an operation of the overheating protection apparatus of the scroll compressor in accordance with the present invention.

In case that the compressor is normally driven, when power is applied to the driving motor 12, the rotating shaft 14 is rotated. The orbiting scroll 40 performs an orbiting movement by the rotation of the rotating shaft 14 to compress fluid flowed into the compression chamber 42 by an interaction with the fixed scroll 36 thereby to discharge it to the high pressure chamber 20 through the discharging hole 46. Then, the high pressure gas flowed in the high pressure chamber 20 is discharged outside through the discharge pipe 24.

While the scroll compressor is driven, if a temperature inside the high pressure chamber 20 rises more than an established temperature, the overheating protection apparatus 60 is driven to maintain the proper temperature inside the high pressure chamber 20 by bypassing the high pressure gas inside the high pressure chamber 20 to the low pressure chamber 22, thereby protecting the compressor.

That is, if the temperature inside the high pressure chamber 20 rises more than an established value, the heat distortion member 66 is thermally varied. As a result of this, the center thereof is convexly protruded to open the passage 70.

Thereafter, the gas of high temperature and high pressure is flowed into the valve housing 72 through the passage 70 and linearly moves the valve body 78 set in the valve housing 72.

Then, the land portion 82 in the valve body 78 connects the first passage 62*a* to the second passage 62*b*, which are bypass passages 62. The gas of high temperature and high pressure inside the high pressure chamber 20 is then bypassed to the low pressure chamber 22 through the bypass passage 62, thereby preventing the temperature and the pressure inside the high pressure chamber 20 from being dramatically risen. According to this, the compressor is protected.

Furthermore, when the gas of high temperature and high pressure is flowed into the low pressure chamber 22 through the bypass passage 62, the motor protection apparatus 90 installed at the upper end of the stator 30 in the driving motor 12 is heated up and driven to stop the operation of the compressor.

At this time, since the compressor has been stopped, the temperature and the pressure inside the high pressure chamber 20 is lowered and then the heat distortion member 66 is returned to its original state, thereby locking the passage 70. And, the valve body 78 is linearly moved back to the original state by an elastic force of the spring 80, thereby locking the bypass passage 62.

Now, it will be described about effect of the scroll compressor according to the present invention which has been constructed and operated as aforementioned.

When the temperature inside the high pressure chamber rises more than an established value while the compressor is driven, the heat protection apparatus mounted in the fixed scroll is driven, thereby bypassing the gas of high temperature and high pressure inside the high pressure chamber to the low pressure chamber. As a result of these, the compressor can be protected and reliability thereof can be thus improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An overheating protection apparatus of a scroll compressor having a discharge valve to permit gas to flow from a fixed scroll into a high pressure chamber, the overheating protection apparatus comprising:

a bypass passage formed in the fixed scroll, the bypass passage connecting the high pressure chamber to a low pressure chamber;

a valve assembly at least partially located in the fixed scroll, the valve assembly opening/closing the bypass passage, the valve assembly including:

a valve housing formed in the fixed scroll and connected with the bypass passage;

a valve body that is linearly movable installed at the valve housing, the valve body opening/closing the bypass passage; and a spring installed at one side surface of the valve body, for providing an elastic force to the valve body; and a heat distortion member configured to permit a flow of gas from the high pressure chamber through a separate passage to drive the valve assembly to open the bypass passage when a temperature inside the high pressure chamber rises more than an established value, wherein the bypass passage includes:

a first passage connected between the high pressure chamber and the valve housing; and a second passage connected between the valve housing and the low pressure chamber, wherein the valve body is provided with a land portion having a smaller diameter in comparison with other portions of the valve body to connect the first passage and the second passage to each other, and wherein the heat distortion member is installed in a mounting groove formed at an upper surface of the fixed scroll, the mounting groove is connected to the separate passage opened/closed by the heat distortion member, and the separate passage is connected to the valve housing of the valve assembly.

2. The apparatus of claim 1, wherein the mounting groove is provided with a stopper to prevent the heat distortion member from being separated.

3. The apparatus of claim 1, wherein the heat distortion member is formed as a plate-like type having a concave center to maintain a state that the separate passage is sealed, and a plurality of through holes through which gas is passed are formed at a circumferential surface thereof.

4. The apparatus of claim 1, wherein the heat distortion member is formed as a bimetal-like type which is varied when heat over a certain value is supplied.

5. The apparatus of claim 1, wherein a motor protection apparatus is installed in the low pressure chamber for stopping an operation of the compressor when the overheating protection apparatus is driven and thus gas of high temperature and high pressure inside the high pressure chamber is flowed into the low pressure chamber.

6. The apparatus of claim 5, wherein the motor protection apparatus is set in an upper surface of a stator of the driving motor installed in the low pressure chamber.

7. The scroll compressor of claim 1, further comprising a separate muffler attached to an upper surface of the fixed scroll.

8. The scroll compressor of claim 1, wherein the fixed scroll has an upper surface, the discharge valve being located at said upper surface, the bypass passage having an inlet in said upper surface.

9. A scroll compressor comprising:

a casing having a high pressure chamber and a low pressure chamber;

a fixed scroll located in the casing;

a discharge valve to permit gas to flow into the high pressure chamber from the fixed scroll;

a bypass passage formed in the fixed scroll, the bypass passage connecting the high pressure chamber to the low pressure chamber;

a valve assembly at least partially located in the fixed scroll, the valve assembly being moveable to open/close the bypass passage, wherein the valve assembly comprises:

a valve housing located in the fixed scroll and connected with the bypass passage;

a valve body that is linearly movable located at the valve housing, the valve body opening/closing the bypass passage; and a heat distortion member configured to permit a flow of gas from the high pressure chamber through a separate passage to drive the valve assembly to open the bypass passage when a temperature inside the high pressure chamber rises more than an established value, wherein the bypass passage includes:

a first passage connected between the high pressure chamber and the valve housing; and a second passage connected between the valve housing and the low pressure chamber, wherein the valve body is provided with a land portion having a smaller diameter in comparison with other portions of the valve body to connect the first passage and the second passage to each other when the valve body is moved to open the bypass passage, and wherein the fixed scroll includes:

a mounting groove formed at an upper surface thereof; and the separate passage connecting the mounting groove to the valve housing; and wherein the heat distortion member is located in the mounting groove to open/close the separate passage connecting the mounting groove to the valve housing.

10. The scroll compressor of claim 9, wherein the valve assembly comprises:

a spring located at one side surface of the valve body, the spring providing an elastic force to the valve body to move the valve body towards closing the bypass passage.

11. The scroll compressor of claim 10, wherein the mounting groove is provided with a stopper to prevent the heat distortion member from being separated.

12. The scroll compressor of claim 10, wherein the heat distortion member is formed as a plate-like type having a concave center to maintain a state that the separate passage is closed when the temperature inside the high pressure chamber is below the established value, and the heat distortion member includes a plurality of through holes through which gas is passed are formed at a circumferential surface thereof.

13. The scroll compressor of claim 10, wherein the heat distortion member is formed as a bimetal-like type which moves the concave center to a state where the separate passage is open when the temperature inside the high pressure chamber is above the established value.

14. The scroll compressor of claim 9, further comprising a motor protection apparatus located in the low pressure chamber of the casing to stop operation of the scroll compressor when the valve assembly is moved to open the bypass passage.

15. The scroll compressor of claim 14, further comprising:

a driving motor located in the casing, the driving motor including a stator having an upper surface, and wherein the motor protection apparatus is set in an upper surface of the stator.

16. The scroll compressor of claim 9, further comprising a separate muffler attached to an upper surface of the fixed scroll.

17. The scroll compressor of claim 9, wherein the fixed scroll has an upper surface, the discharge valve being located at said upper surface, the bypass passage having an inlet in said upper surface.

* * * * *